US009721554B2

(12) United States Patent
Coutlee

(10) Patent No.: US 9,721,554 B2
(45) Date of Patent: Aug. 1, 2017

(54) DETACHABLE FINGERGRIP WHISTLE SYSTEM

(75) Inventor: Craig Coutlee, Durango, CO (US)

(73) Assignee: Craig Coutlee, Durango, CO (US)

( * ) Notice: Subject to any disclaimer, the term of this patent is extended or adjusted under 35 U.S.C. 154(b) by 679 days.

(21) Appl. No.: 12/966,605

(22) Filed: Dec. 13, 2010

(65) Prior Publication Data

US 2012/0148991 A1 Jun. 14, 2012

(51) Int. Cl.

| | |
|---|---|
| ***G10K 5/00*** | (2006.01) |
| ***A63H 5/00*** | (2006.01) |
| ***A63H 33/26*** | (2006.01) |
| *A63B 71/06* | (2006.01) |

(52) U.S. Cl.

CPC ..... *G10K 5/00* (2013.01); *A63B 71/06* (2013.01); *A63H 5/00* (2013.01); *A63H 33/26* (2013.01); *A63B 2071/0602* (2013.01); *A63B 2209/08* (2013.01); *A63B 2209/10* (2013.01)

(58) Field of Classification Search

CPC ..... A63H 33/046; A63H 33/26; G10K 5/00
USPC ..... 446/92, 129, 137, 202, 204–206, 216, 446/247, 397; 116/137 R; D10/119.2, D10/119.3, 121

See application file for complete search history.

(56) References Cited

U.S. PATENT DOCUMENTS 2,697,642 A * 12/1954 Rudy ..... 403/410
2,731,663 A * 1/1956 Thompson ..... A47J 45/074 16/422
2,947,456 A * 8/1960 Seron ..... A45F 5/00 224/258
3,302,566 A * 2/1967 Blanchet ..... 101/405
4,182,470 A * 1/1980 Atkinson ..... A45F 5/00 206/315.3
4,392,325 A * 7/1983 Woronets ..... G10K 5/00 446/204
5,165,423 A * 11/1992 Fowler ..... A63B 71/085 128/861
5,391,184 A * 2/1995 Rosenthal ..... A61J 17/00 606/234
6,109,490 A * 8/2000 Caluori ..... A44C 5/0007 2/160

(Continued)

FOREIGN PATENT DOCUMENTS

WO WO 2010042532 A2 * 4/2010 ..... A44B 5/002

*Primary Examiner* — Gene Kim
*Assistant Examiner* — Alyssa Hylinski
(74) *Attorney, Agent, or Firm* — Polsinelli PC

(57) ABSTRACT

A whistle system that enables an official or other user to not only have the whistle in a secure position for quick and easy use while also enabling the user to be able to use both hands as well. In particular, the whistle system includes a fingergrip that allows the user to quickly move the the whistle in position for use in a natural motion, while allowing the fingergrip to then quickly separate from the whistle to allow both hands of the user to be utilized. Alternatively, the whistle allows individuals with restricted movement in one arm to still officiate. A user having restricted movement in one arm can simply wear the whistle on one hand, move it into position in the mouth to be blown, and then quickly separated from the whistle to allow the signal to be indicated with one hand. The whistle system includes a whistle with a fingergrip. The fingergrip is securely attached to the whistle by a securement system that also allows the fingergrip to be separated from the whistle with an application of force.

6 Claims, 3 Drawing Sheets

(56) References Cited

U.S. PATENT DOCUMENTS

| | | | | |
|---|---|---|---|---|
| 6,112,330 | A * | 9/2000 | Bryan | A41D 19/0031 116/137 R |
| 6,282,760 | B1 * | 9/2001 | Mars | A44B 9/16 24/303 |
| 6,416,379 | B1 | 7/2002 | Topman | |
| D621,290 | S | 8/2010 | Foxcroft | |
| 8,220,188 | B1 * | 7/2012 | Keller | 40/593 |
| 2003/0058744 | A1 * | 3/2003 | Calace | A63B 71/0605 368/109 |
| 2004/0200236 | A1 * | 10/2004 | Emberson | A44C 15/00 63/23 |
| 2005/0082323 | A1 * | 4/2005 | O'Hair | 224/219 |
| 2009/0193630 | A1 | 8/2009 | Petzl | |
| 2010/0080087 | A1 | 4/2010 | Shupp | |
| 2010/0089151 | A1 * | 4/2010 | Mantilla et al. | 73/426 |
| 2010/0219217 | A1 * | 9/2010 | Andochick | A45F 5/02 224/250 |
| 2010/0242289 | A1 * | 9/2010 | Roskam | B26B 13/20 30/232 |
| 2011/0254225 | A1 * | 10/2011 | Doherty | A44B 5/002 273/287 |

* cited by examiner

DETACHABLE FINGERGRIP WHISTLE SYSTEM

FIELD OF THE INVENTION

This invention relates to the field of sports officating whistles, and more particularly to the field of fingergrip whistles.

BACKGROUND OF THE INVENTION

Whistles have been in use for centuries for various forms of signaling. In particular, whistles have been used in sports officating to indicate initiating play, stoppage of play, penalties and other uses. These whistles come in various forms such as pea whistles, pea-less whistles, electronic whistles and other types.

The whistles used for sports officating are typically either held in the officials mouth, in their hand, worn on lanyards around the neck, or in one popular form, on fingergrips. The wearing the whistle in the mouth during play is discouraged as the official is prone to injury with the whistle in the mouth, the possibility of the whistle being dropped, the inability to talk, and the possibility of an inadvertent whistle. Carrying the whistle in the hand can result in the whistle being dropped during play. Wearing the whistle on a lanyard around the neck keeps the whistle safe, but can lead to delays while the whistle is located. Fingergrip whistles, such as the Fox 40 whistle, distributed by Fox 40 International is similar to the whistle described in U.S. Pat. No. 4,392,325, issued to Woronets and shown in FIG. 1, incorporated herein by reference. The fingergrip whistle allows officials to wear the whistle on one or more fingers so that the whistle is always ready.

One problem with the use of the fingergrip style of whistle is the inability to use two hands to signal the penalty or other reason for whistle being blown until after the whistle has been blown. As shown in FIG. 2, many times the official must use two hands for the indication for the whistle. This is not a problem with the use of a neck lanyard, but creates a problem when a fingergrip whistle is being used. The official must remove the whistle from the mouth in order to use both hands. Since it is often critical to signal as quickly as possible to keep play going forward, this can be a problem with fingergrip whistles.

Another issue that comes up with the use of fingergrip whistles is that they are not usable with users having restricted movement in one arm. Some users may have a temporary or permanently disability in the movement of one arm. Since fingergrip whistles require one arm to move the whistle to the mouth and maintained there while the whistle is blown, the user is unable to signal the action.

SUMMARY OF THE INVENTION

In accordance with the present invention, a whistle system is provided that enables an official or other user to not only have the whistle in a secure position for quick and easy use while also enabling the user to be able to use both hands as well. In particular, the whistle system includes a fingergrip that allows the user to quickly move the whistle in position for use in a natural motion, while allowing the fingergrip to then quickly separate from the whistle to allow both hands of the user to be utilized. Alternatively, the whistle allows individuals with restricted movement in one arm to still officiate. A user having restricted movement in one arm can simply wear the whistle on one hand, move it into position in the mouth to be blown, and then quickly separated from the whistle to allow the signal to be indicated with one hand.

A preferred embodiment of the present invention includes a whistle with a fingergrip. The fingergrip is securely attached to the whistle by a securement system that also allows the fingergrip to be separated from the whistle with an application of force. The securement system includes a first magnet attached to the whistle with a second magnet of opposing polarity attached to the fingergrip. The fingergrip is thus securely held to the whistle by the magnetic forces between the magnets. In use, the whistle is easily moved to the mouth of the user where the mouth holds the whistle while the fingergrip is moved away from the whistle to allow the user to have free use of that hand.

These and other features of the claimed inventions will be evident from the ensuing detailed description of preferred embodiments, from the claims and from the drawings.

DETAILED DESCRIPTION OF PREFERRED EMBODIMENTS

The present invention provides a whistle for general use but in particular for use in sports officiating. It is to be expressly understood that this exemplary embodiment is provided for descriptive purposes only and is not meant to unduly limit the scope of the present inventive concept. Other embodiments of the skin care products and methods of use of the present invention are considered within the present inventive concept as set forth in the claims herein. For explanatory purposes only, the whistle embodiments and methods of use of the preferred embodiments are discussed primarily for the purposes of understanding the method of installation. It is to be expressly understood that other products and methods are contemplated for use with the present invention as well.

In accordance with the present invention, the whistle enables an official or other user to not only have the whistle in a secure position for quick and easy use while also enabling the user to be able to use both hands as well. In particular, the whistle system includes a fingergrip that allows the user to quickly move the whistle in position for use in a natural motion, while allowing the fingergrip to then quickly separate from the whistle to allow both hands of the user to be utilized. Alternatively, the whistle allows individuals with restricted movement in one arm to still officiate. A user having restricted movement in one arm can simply wear the whistle on one hand, move it into position in the mouth to be blown, and then quickly separated from the whistle to allow the signal to be indicated with one hand. The whistle system includes a whistle with a fingergrip. The fingergrip is securely attached to the whistle by a securement system that also allows the fingergrip to be separated from the whistle with an application of force.

Figure 1:
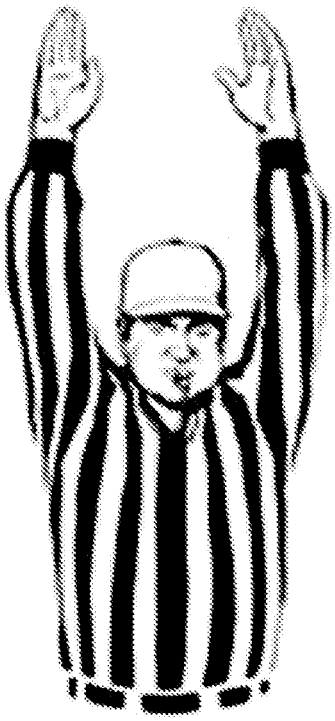
Figure 1 (Prior Art)
FIG. 1 is an illustration of an official blowing a whistle while using both hands to signal the reason for the blown whistle.
Figure 2:
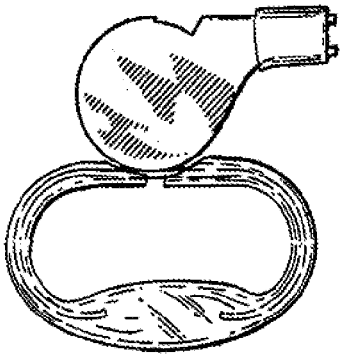
Figure 2 (Prior Art)
FIG. 2 is an illustration of the fingergrip whistles of the prior art.
Figure 3:
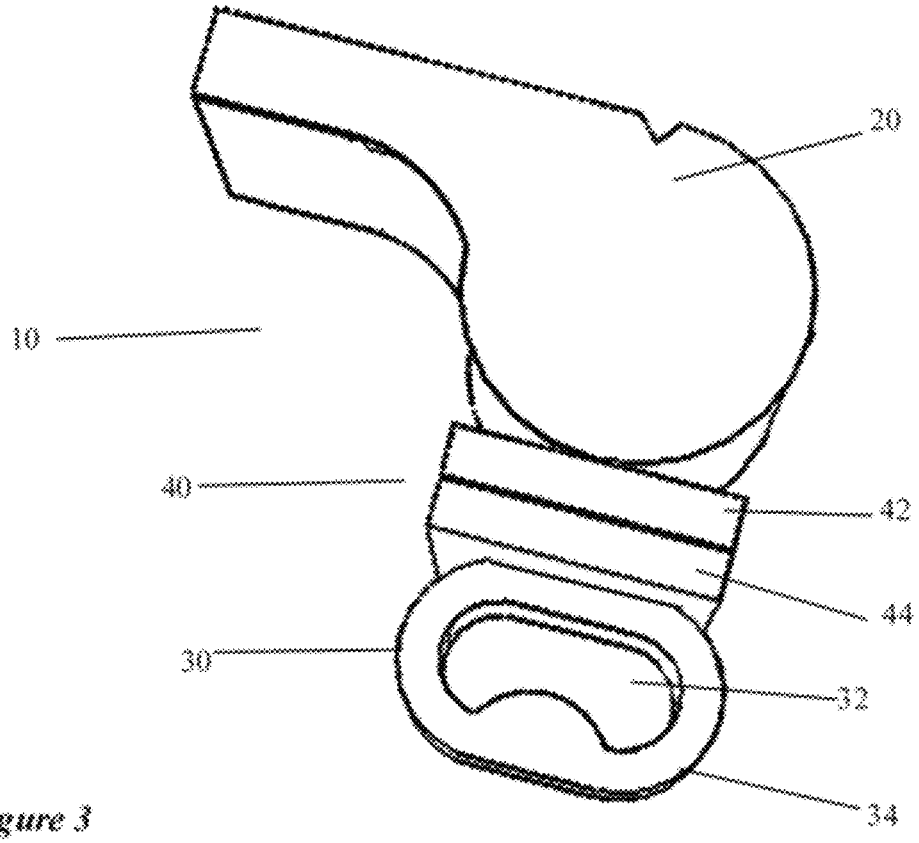
FIG. 3 is a perspective illustration of the preferred embodiment of the present invention in the assembled whistle configuration.
Figure 4:
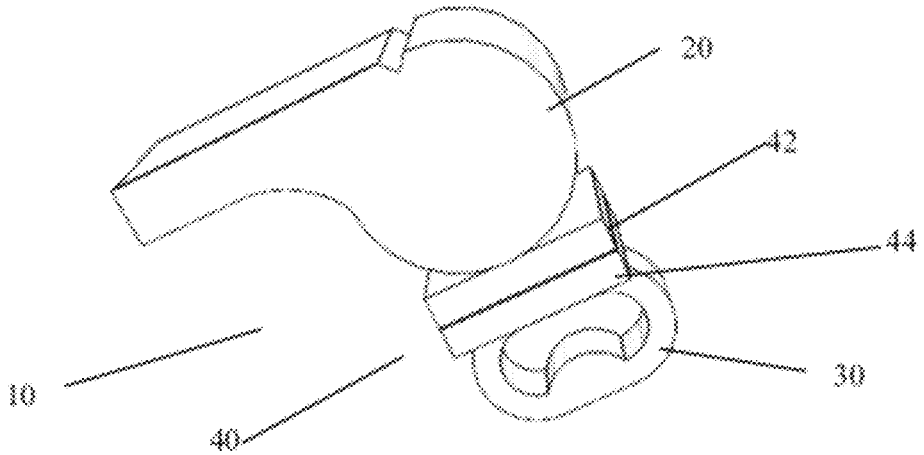
FIG. 4 is a different perspective view of the preferred embodiment of FIG. 3.
Figure 5:
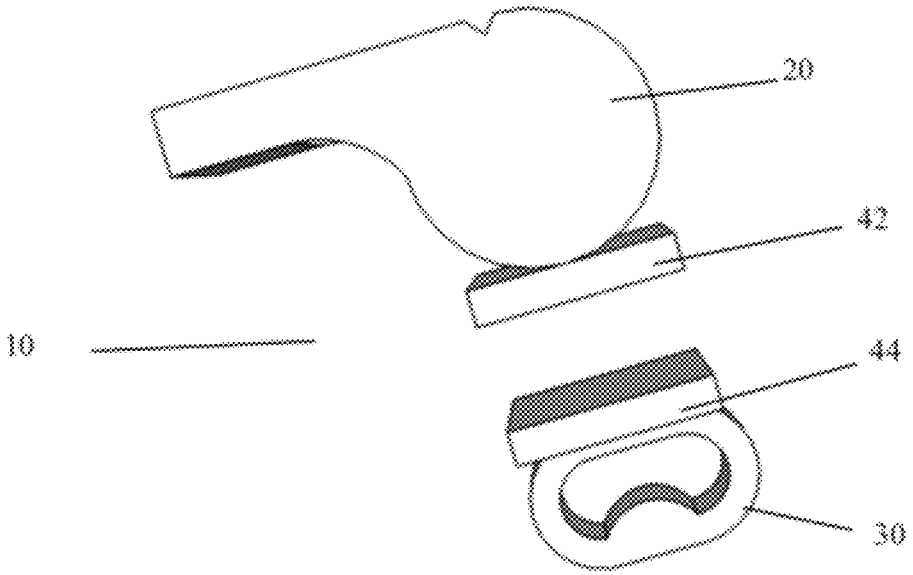
FIG. 5 is a perspective illustration of the preferred embodiment of FIG. 3 in a separated configuration.
Figure 6:
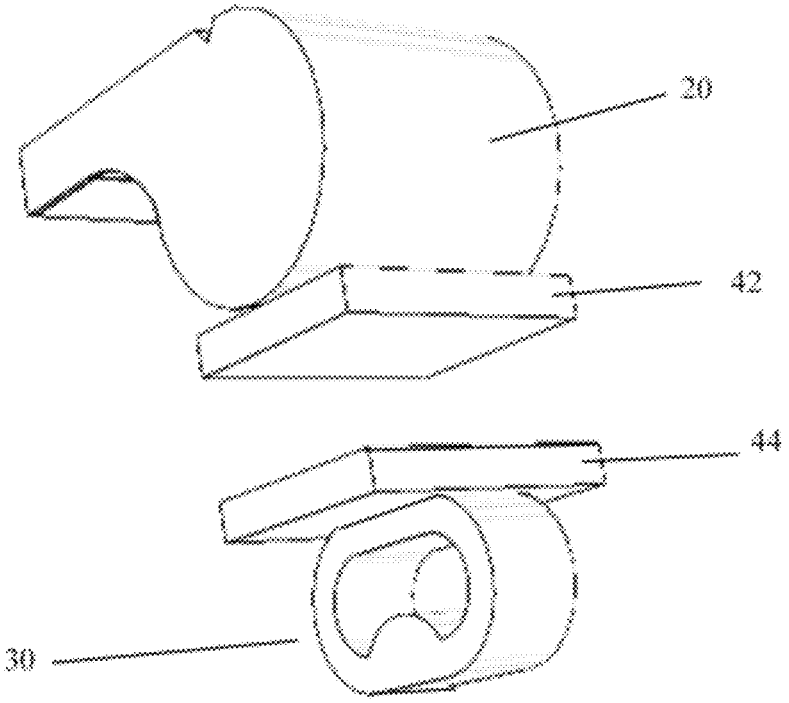
FIG. 6 is another view of the preferred embodiment in the separated configuration.

The whistle system 10 of a preferred embodiment is illustrated in FIGS. 3-6. The whistle system 10 includes a whistle 20, a fingergrip 30 and an engagement system 40 to releasable secure the fingergrip 30 to the whistle 20. It is critical that the engagement system 40 secures the fingergrip securely to the whistle to prevent accidental dislodgement of the whistle and the fingergrip while still allowing the fingergrip to disengage when desired.

The whistle 20 can be of any desired design, including pea whistles, pea-less whistles, electronic whistles or any other whistle design. Typically the whistle will have a plenum opening into a chamber with a release opening and either a pea or baffle to create the noise. One preferred whistle design is the pea-less whistle distributed by Fox 40 International as the Fox 40 whistle. It is to be expressly understood that any other whistle design may be used as well and are covered within the claimed inventions. The system can also be used with any other signaling device as well, such as electronic signaling devices and other devices.

The design of the fingergrip 30 can also be similar to the design of the fingergrip of the Fox 40 whistle or the whistle disclosed in U.S. Pat. No. 4,392,325 and disclosed herein by reference. Typically the fingergrip includes a "C" shape with a substantially oval opening to allow one or more fingers to be inserted in the opening. The fingergrip is formed of a relatively stiff inner material to provide structure covered with a resilient material for padding. Alternatively, the fingergrip can be formed from tubing or other materials that will provide some degree of structural integrity with a resilient padding. While the preferred embodiment includes the use of a fingergrip, other types of securing mechanisms can be used as well. For example, a lanyard can be used that is secured around the neck or wrapped about the hand. A glove could also be used as well that is slipped over the hand. Other types of gripping mechanisms can be used as well, such as an elastic band that slips over a portion of the hand or fingers.

The engagement mechanism can be of many different configurations. The engagement mechanism 40 of the descriptive embodiment includes two powerful magnets 42, 44. The magnet 42 is affixed to the lower surface of the whistle 20 while the magnet 44 is affixed to the upper surface of the fingergrip 30. The polarity of the magnets will be selected so that the lower surface of magnet 42 is attracted to the upper surface of the magnet 44. It is to be expressly understood that the placement of the magnets can be changed for ergonomic or safety reasons or for other reasons. The size and strength of the magnets are selected so that the whistle is securely attached to the fingergrip so that it will not accidentally become dislodged even during collisions or other impacts, but will release with a horizontal force with the whistle engaged in the mouth. The selection of the magnets is determined with these factors in mind along with the size of the whistle, fingergrip and other factors. Other types of engagement mechanisms could be used as well, such as a hook and loop fabric, such as Velcro, adhesives having a slight tack or any number of other mechanisms.

Another embodiment of the present invention includes a single magnet attached to either the whistle or the fingergrip. The mating surface of the opposing device is formed from a material that attracted to magnets, such as ferromagnetic materials. The force from the magnet will attract the opposing mating surface to form a secure engagement between the whistle and fingergrip that can be separated during use.

Use

In use, the whistle system is held by inserting one or more fingers of a hand into the fingergrip. This allows the user to have relatively free movement of the hand while securely holding the whistle to be available for use. The user simply moves their hand in a natural movement so that the whistle is engaged by the mouth of the user. Once the user is securely holding the whistle in their mouth, the user then moves their hand away from their mouth in a plane that is substantially horizontal to the plane of the engaging surfaces of the magnet. This movement slides the magnets relative to one another until the magnets release. This movement requires less force than pulling the magnets vertically apart from one another due to the magnetic flux field holding the magnets together.

The user then has free movement of that hand for signaling an indication for the blowing of the whistle. This allows both hands to be used, or in the case of an individual with restricted movement of one hand or arm, for the movable arm to be free for use. Many sports require complicated signals due to the number of fouls or stoppages of play, so that both hands are necessary for the proper signal to be indicated.

These above descriptive embodiments are provided for explanatory purposes only, and are not meant to limit the scope of the claimed inventions. Other embodiments are considered with in the scope of the claimed inventions as well.

What is claimed is:

1. A method for officiating a sporting event comprising:

using a signaling system having a signaling device, a securing mechanism for securely holding the signaling device and an engagement mechanism for magnetically securing the signaling device to the securing mechanism, the securing mechanism comprising;

a first magnet rigidly attached to a bottom portion of the signaling device and having a first planar engagement surface and a first polarity, the first planar engagement surface disposed between four planar edges of the first magnet, a second magnet rigidly attached to the securing mechanism and having a second planar engagement surface and a second polarity opposing the first polarity, the second planar engagement surface disposed between four planar edges of the second magnet, wherein the signaling device is magnetically secured to the securing mechanism via the first planar engagement surface and the second planar engagement surface magnetically engaging each other such that the four planar edges of the first magnet generally align with the four planar edges of the second magnet, the method comprising:

gripping the securing mechanism using a pair of adjacent fingers;

directing the signaling device to the mouth while gripping the securing mechanism using the pair of adjacent fingers;

gripping the signaling device using the mouth;

moving the securing mechanism away from the mouth in a substantially horizontal direction while gripping the signaling device using the mouth to separate the signaling device from the securing mechanism wherein the moving of the securing mechanism away from the mouth in a substantially horizontal direction comprises sliding the second planar engagement surface along the first planar engagement surface to disengage the securing mechanism from the signaling device; and activating the signaling device using the mouth.

2. The method of claim 1 wherein the signaling device comprises a whistle.

3. The method of claim 1 wherein the securing mechanism comprises a fingergrip defining an opening for receiving the pair of adjacent fingers to facilitate gripping of the fingergrip.

4. The method of claim 1 wherein the securing mechanism comprises a glove.

5. The method of claim 3 wherein a first edge and a second edge of the four planar edges of the second magnet are generally parallel with opposing sides of a planar portion of the fingergrip so as to orient a tip of the signaling device generally orthogonally to an axis extending through the opening in one of a plurality of possible positions.

6. The method of claim 5 wherein the first and second magnets are a same shape and size so as to magnetically orient the four planar edges of the first magnet and the four planar edges of the second magnet into general alignment with each other in the one of the plurality of possible positions.

* * * * *